US005472098A

United States Patent [19]

Ho

[11] Patent Number: 5,472,098

[45] Date of Patent: Dec. 5, 1995

[54] MULTIPURPOSE COMBINATION BOOK RACK

[76] Inventor: Cheng-Cheng Ho, P.O. Box 1750, Taichung, Taiwan

[21] Appl. No.: 263,739

[22] Filed: Jun. 22, 1994

[51] Int. Cl.[6] ..... A47B 23/00; A47B 73/00; A47B 85/00

[52] U.S. Cl. ..... 211/2; 211/74; 211/189; 248/150; 248/460

[58] Field of Search ..... 211/74, 85, 42, 211/43, 2, 189; 248/441.1, 460, 446, 450, 451, 150, 165, 105–127

[56] References Cited

U.S. PATENT DOCUMENTS 2,286,128 6/1942 Unger ..... 248/441.1
3,079,003 2/1963 Hilsinger, Jr. ..... 211/189 X
3,297,164 1/1967 Hutchinson ..... 211/42
3,464,565 9/1969 Nevai ..... 211/42
3,870,155 3/1975 Galloway ..... 248/150 X

*Primary Examiner*—Ramon O. Ramirez
*Assistant Examiner*—Korie H. Chan

[57] ABSTRACT

A multipurpose combination book rack comprises two side plates, each of which is provided with a top bevel. An upper cross rod and a lower cross rods are removably mounted across the two side plates. The lower cross rod is positioned adjacent a front cross rod which is greater in height than the lower cross rod to define a shoulder therewith. The upper and the lower cross rods are provided respectively with a plurality of arcuate recesses for displaying a large-sized hardcover book, and with a plurality of recesses for displaying the beverage bottles.

3 Claims, 6 Drawing Sheets

MULTIPURPOSE COMBINATION BOOK RACK

FIELD OF THE INVENTION

The present invention relates generally to a book rack for holding a book open before a reader, and more particularly to a multipurpose combination book rack.

BACKGROUND OF THE INVENTION

A book rack is intended to afford a book reader a reading comfort and is useful especially for holding a large-sized hardcover book in a manner permitting the book reader to read the book comfortably and to turn the pages of the book easily.

As shown in FIG. 1, a large-sized bound book has a front cover 10, a back cover 11, a book-binding headband 12, and gatherings 13 held between the front cover 10 and the back cover 11. Located respectively between the front cover 10 and the headband 12, and between the back cover 11 and the headband 12 are hinges 14 and 15, which are intended to facilitate a reader to turn the front cover 10 and the back cover 11. The headband 12 is connected with a book spine 16, thereby causing the open pages 17 and 18 to be unable to spread out fully, as shown in FIG. 1. The reader is often annoyed or even frustrated at having to press the open pages 17 and 18 with hands. However, when the open pages 17 and 18 are spread out fully, the displaying positions of the open pages 17 and 18 are such that the reader is bound to strain his or her eyes.

Referring to FIG. 2, another large-sized bound book is shown comprising a front cover 20, a back cover 21, an arcuate headband 22, gatherings 23 fastened to an inner spine 24, and hinges 25 and 26. As shown in FIG. 2, open pages 27 and 28 can be spread out fully without using a reader's hands. However, when the book is placed on a desk, the arcuate headband 22 is flattened by the weight of the book to make the leafing of the book awkward.

A book rack or stand is intended to overcome the problems described above. A conventional book rack of the prior art is generally provided with a book support having a surface of an appropriate inclination to facilitate a reader to read the book comfortably; nevertheless such a prior art book rack as described above is defective in design in that it is fixed and cumbersome, and that it does not solve the problem that the flattened arcuate headband 22 can cause the leafing of the book awkward.

SUMMARY OF THE INVENTION

It is therefore the primary objective of the present invention to provide a multipurpose combination book rack, which comprises two side plates, each of which is provided with a top bevel. An upper cross rod and a lower cross rod are movably mounted across the two side plates. The lower cross rod is located by means of a front cross rod. The upper and the lower cross rods are provided respectively with a plurality of arcuate recesses.

It is another objective of the present invention to provide a multipurpose combination book rack, which comprises upper and lower cross rods provided respectively with a plurality of recesses corresponding in location for converting the book rack into a rack for use in displaying the beverage containers.

The foregoing objectives, features and advantages of the present invention will be more readily understood upon a thoughtful deliberation of the following detailed description of the present invention in conjunction with the accompanying drawings.

DETAILED DESCRIPTION OF THE INVENTION

Figure 1:
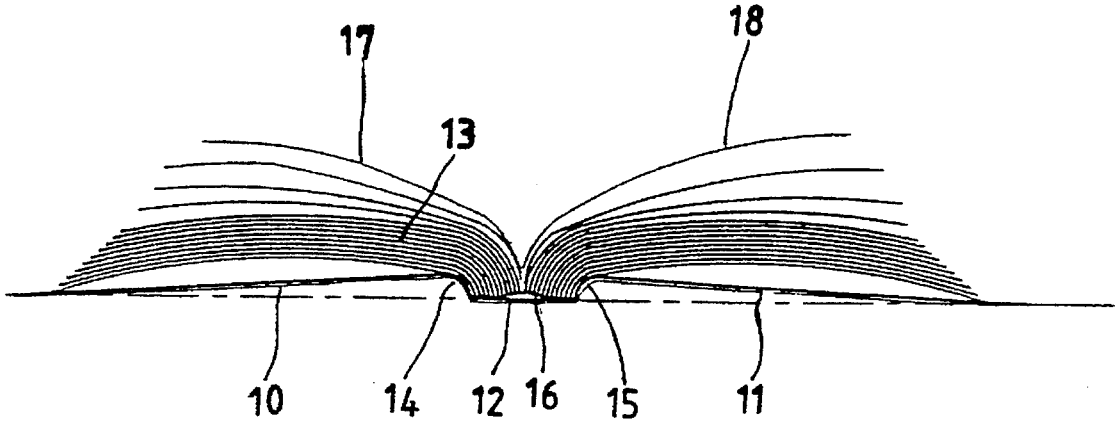
PRIOR ART FIG.1
FIG. 1 shows a front elevational view of a large-sized hardcover book which is spread out.
Figure 2:
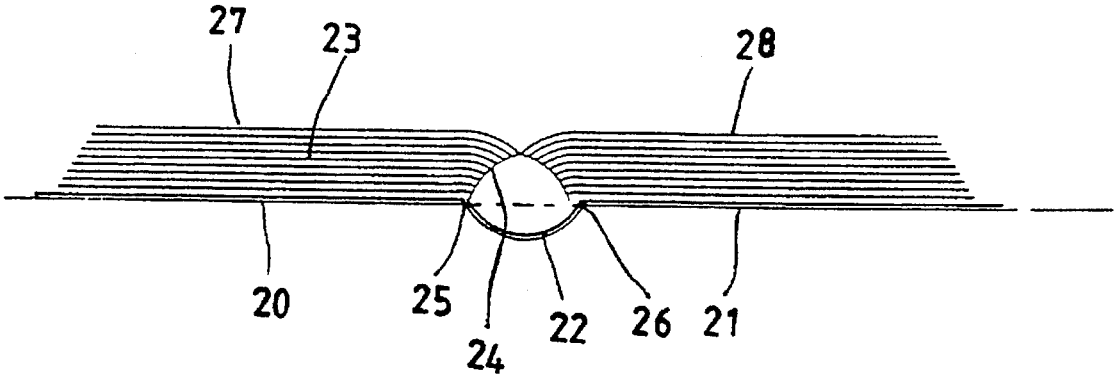
PRIOR ART FIG.2
FIG. 2 shows a front elevational view of another large-sized hardcover book that is spread out.
Figure 3:
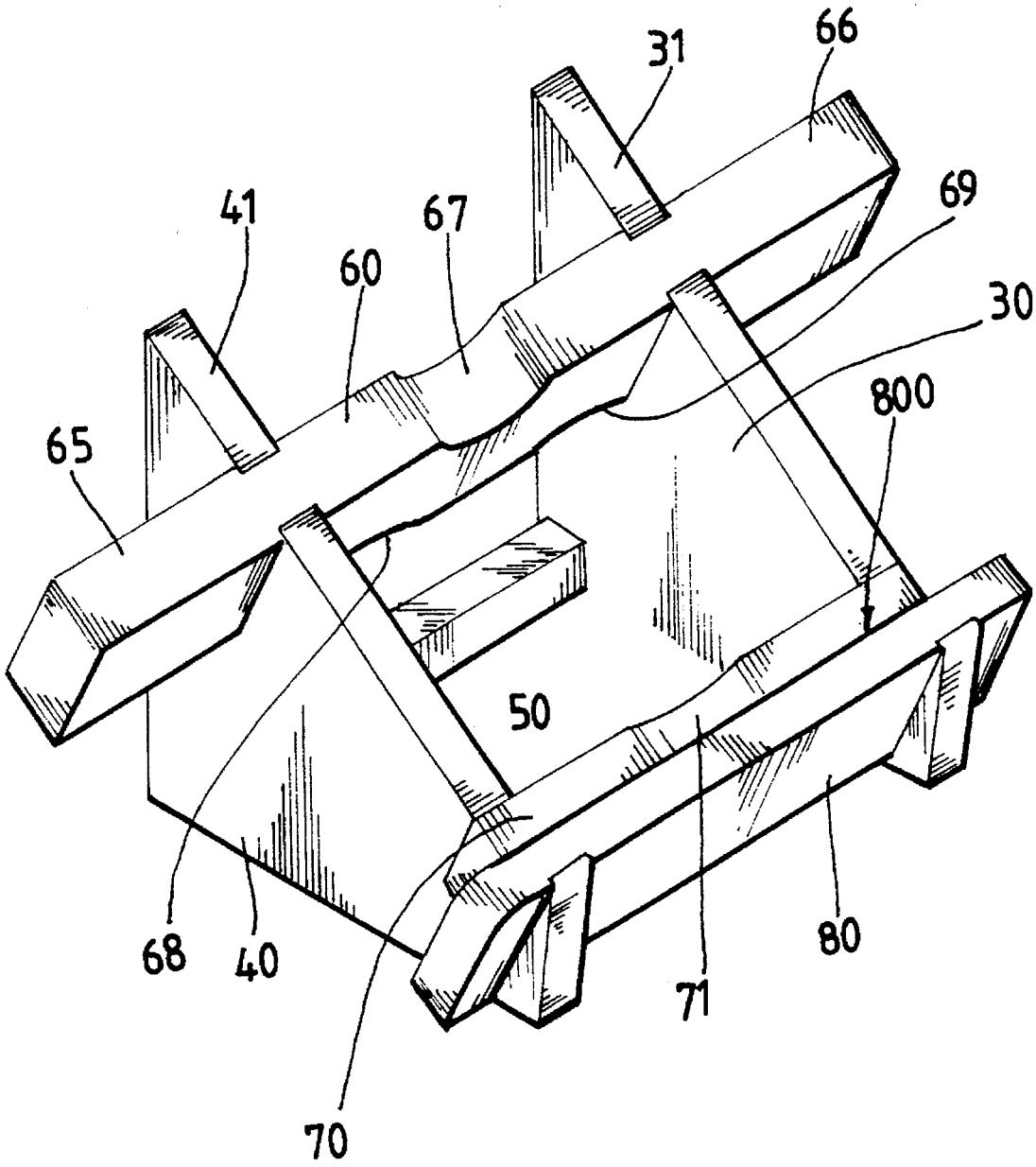
FIG. 3 shows a perspective view of a book rack embodied in the present invention.
Figure 4:
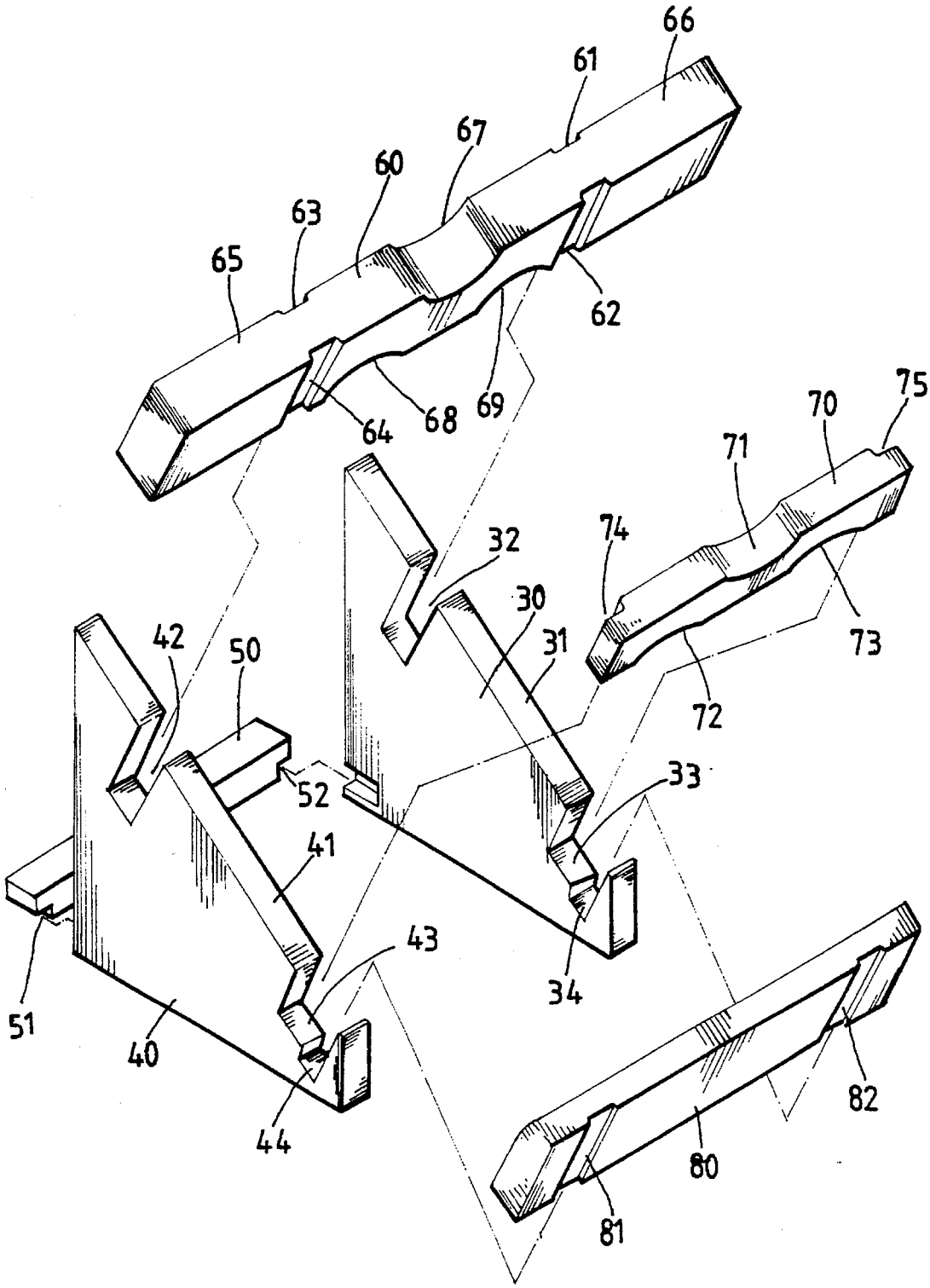
FIG. 4 shows an exploded view of the book rack as shown in FIG. 3.

As shown in FIGS. 3 and 4, the book rack of the present invention comprises two side plates 30 and 40 opposite to each other and having respectively top bevels 31 and 41. The two side plates 30 and 40 are provided respectively with upper slots 32 and 42, and with lower slots 33, 34, 43 and 44. The two side plates 30 and 40 are further provided respectively with recesses 35 for disposing a bottom support rod 50 having indentations 51 and 52.

The upper cross rod 60 is received in the upper slots 32 and 42 of the two side plates 30 and 40, and is provided with recesses 61, 62, 63 and 64. It is preferable that the upper cross rod 60 is provided with two extension portions 65 and 66 on which both hands of a book reader can rest. The upper cross rod 60 is provided centrally on the top surface thereof with a arcuate recess 67. In addition, the upper cross rod 60 is provided in the underside surface thereof with arcuate recesses 68 and 69.

The lower cross rod 70 is shorter than the upper cross rod 60 and provided centrally on the top surface thereof with an arcuate recess 71. In addition, the lower cross rod 70 is provided in the underside surface thereof with arcuate recesses 72 and 73 corresponding in location to the actuate recesses 68 and 69 of the upper cross rod 60. The lower cross rod 70 is further provided in the back side thereof with cuts 74 and 75.

The front cross rod 80 of an appropriate length is higher than the lower cross rod 70. The front cross rod 80 is provided with recesses 81 and 82. The cuts 74 and 75 of the lower cross rod 70 are engageable with slots 33 and 43 of the two side plates 30 and 40. The recesses 81 and 82 of the front cross rod 80 are engageable with the slots 34 and 44 of the two side plates 30 and 40 so as to locate the lower cross rod 70 and to form a shoulder 800, as shown in FIG. 3.

Figure 5:
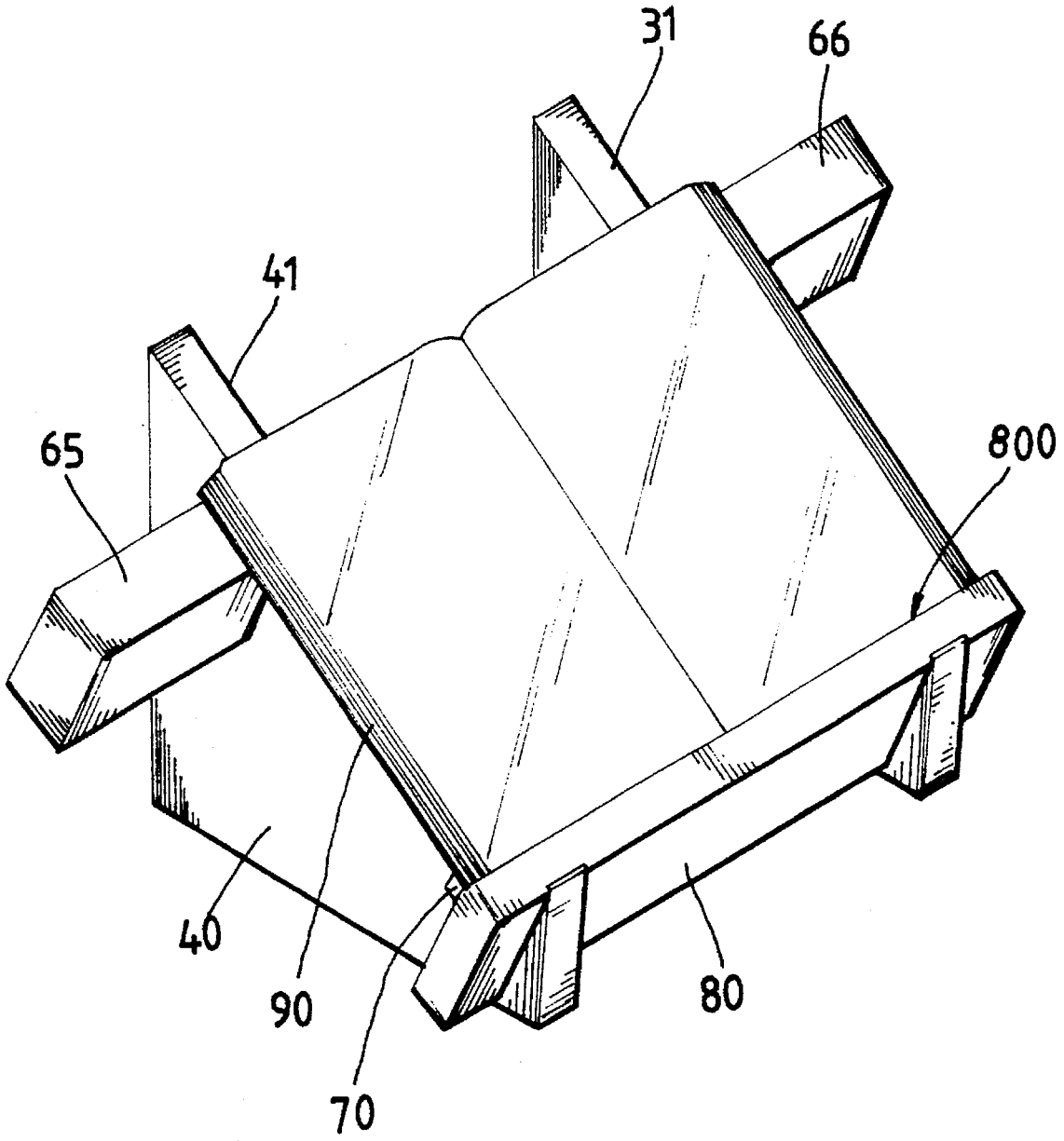
FIG. 5 is a schematic view showing that a large-sized book is displayed on the book rack of the present invention.

The recesses 61, 62, 63 and 64 of the upper cross rod 60 engage the slots 32 and 42 of the two side plates 30 and 40 such that the arcuate recess 67 is opposite in location to the arcuate recess 71 of the lower cross rod 70. A large-sized book 90 is displayed on the book :rack of the present invention such that the lower edge of the book presses against the shoulder 800 of the front cross rod 80, as shown in FIG. 5.

Figure 6:
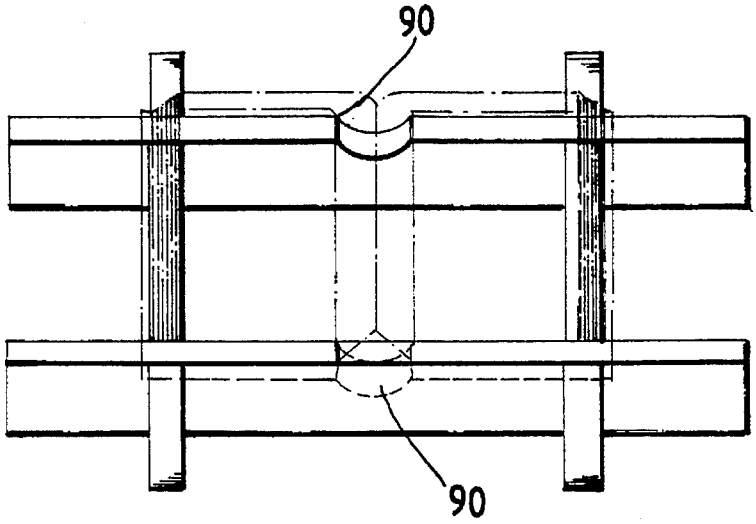
FIG. 6 shows a front elevational view of the book rack on which the large-sized book is displayed as shown in FIG. 5.
Figure 7:
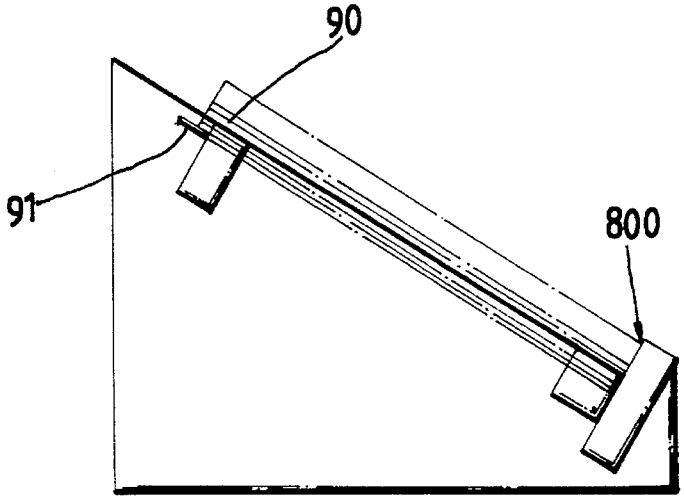
FIG. 7 shows a side elevational view of the book rack on which the large-sized book is displayed as shown in FIG. 5.

As shown in FIGS. 6 and 7, when the large-sized book 90 is spread out on the book rack of the present invention, the headband 91 of the large-sized book 90 is not flattened by virtue of the fact the headband 91 is received in the arcuate recesses 67 and 71 of the upper and the lower cross rods 60 and 70. As a result, the reader can leaf the book 90 easily.

Figure 8:
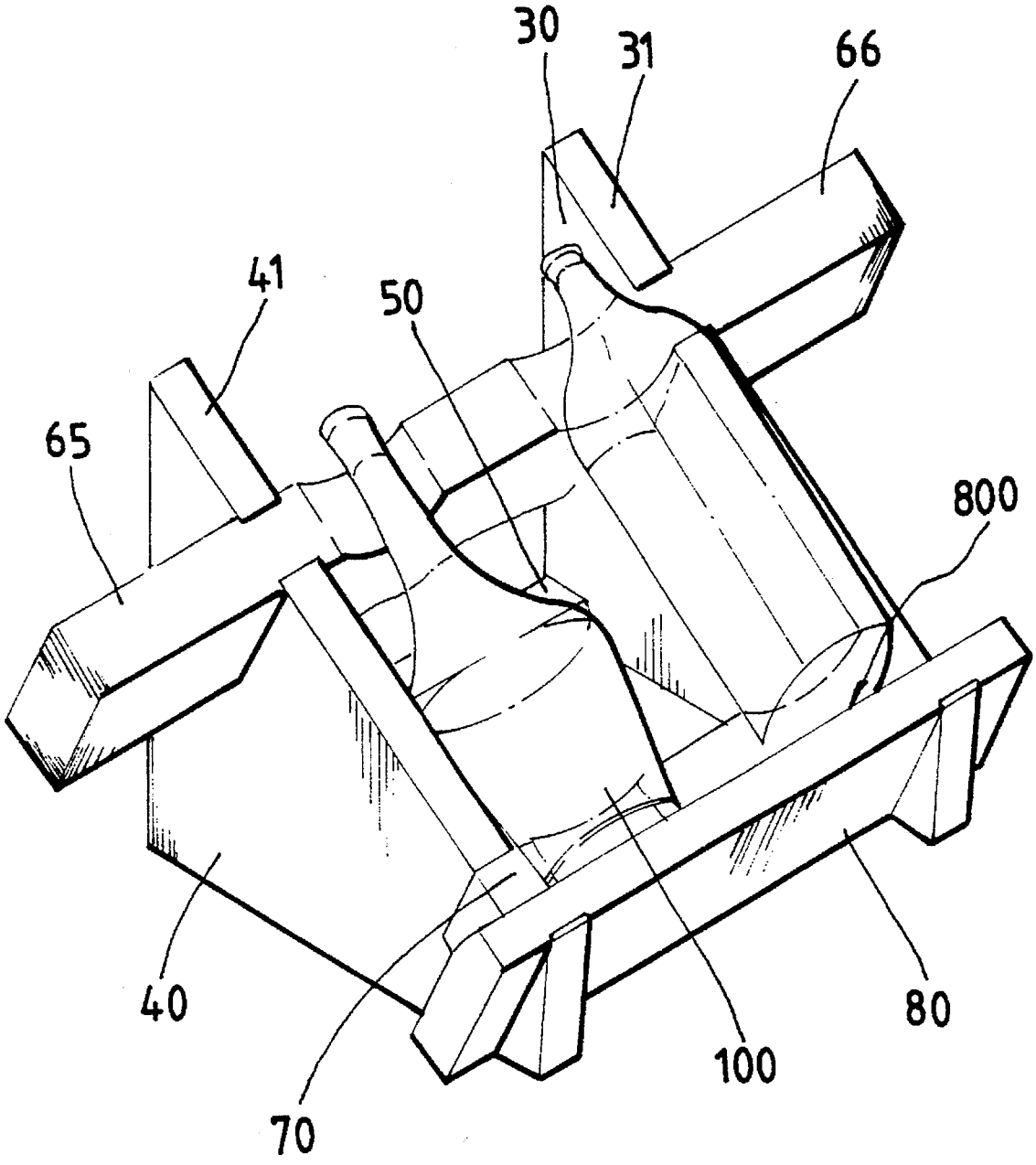
FIG. 8 is a schematic view showing that the book rack of the present invention is converted into a rack for displaying the beverage bottles.

As shown in FIG. 8, the book rack of the present invention is converted into a wine rack for displaying the wine bottle 100. Such a conversion is made possible by the upper and the lower cross rods 60 and 70, which are movably joined with the two side plates 30 and 40 such that the upper and the lower cross rods 60 and 70 can be mounted reversibly to let the underside arcuate recesses 68, 69, 72 and 73 to face the front side of the rack.

What is claimed is:

1. A book rack comprising two side plates, each of said side plates is provided with a top bevel, an upper cross rod, a lower cross rod, a front cross rod, and a bottom support rod; wherein said upper cross rod, said lower cross rod, said front cross rod, and said bottom support rod are removably mounted across said two side plates, said lower cross rod being disposed adjacent said front cross rod, said upper cross rod and said lower cross rod having respectively on a top surface thereof an arcuate recess for receiving therein a book-binding headband of a large-sized hardcover book which is displayed on said upper cross rod and said lower cross rod, said upper cross rod and said lower cross rod having respectively on an underside surface thereof a plurality of arcuate recesses for displaying a plurality of beverage bottles.

2. The book rack according to claim 1, wherein each of said side plates is provided respectively with a slot, said upper cross rod is provided respectively on opposite side surfaces thereof with two recesses for engaging a respective one of said slots of said two side plates.

3. The book rack according to claim 1 wherein each of said side plates is provided respectively with a slot, said lower cross rod is provided with two cuts for engaging a respective one of said sots of said two side plates; and wherein said front cross rod has a height greater than a height of said lower cross rod for forming a shoulder.

* * * * *